US005385616A

United States Patent [19]

Dougherty et al.

[11] Patent Number: 5,385,616

[45] Date of Patent: Jan. 31, 1995

[54] CORROSION INHIBITION BY FORMATION OF IRON CARBOXYLATE

[75] Inventors: James A. Dougherty, Manchester; George W. Dear, Florissant; Bernardus A. Oude, St. Louis, all of Mo.

[73] Assignee: Petrolite Corporation, St. Louis, Mo.

[21] Appl. No.: 195,240

[22] Filed: Feb. 14, 1994

[51] Int. Cl.[6] ..... C23C 22/48

[52] U.S. Cl. ..... 148/248; 148/252; 148/274; 106/14.41; 427/388.1; 427/384

[58] Field of Search ..... 148/274, 252, 248; 106/14.41; 427/239, 388.1, 384

[56] References Cited

U.S. PATENT DOCUMENTS

| | | | |
|---|---|---|---|
| 2,343,644 | 3/1944 | Cawley | 260/405.6 |
| 3,162,658 | 12/1964 | Baltes et al. | 260/405.6 |
| 3,753,968 | 8/1973 | Ward | 260/97.6 |
| 4,156,095 | 5/1979 | Jevne et al. | 562/509 |
| 4,547,224 | 10/1985 | Schilling | 106/273 |
| 4,658,036 | 4/1987 | Schilling | 548/513 |
| 4,676,927 | 6/1987 | Schilling et al. | 252/311.5 |
| 4,861,377 | 8/1989 | Schilling | 106/277 |
| 4,927,669 | 5/1990 | Knox et al. | 427/239 |
| 5,085,702 | 2/1992 | Schilling et al. | 106/277 |
| 5,167,694 | 12/1992 | Robinson | 71/92 |
| 5,194,640 | 3/1993 | Cosgrove et al. | 554/126 |

*Primary Examiner*—Sam Silverberg
*Attorney, Agent, or Firm*—Kenneth Solomon

[57] ABSTRACT

A method for inhibiting corrosion of a metal surface bearing a corrosion product including ferrous ions is disclosed. The method comprises applying to the surface a reaction product of an alcohol and a fatty acid maleic anhydride adduct produced by a reaction between maleic anhydride and an unsaturated fatty acid. Related compositions and coated metal surfaces are also disclosed.

12 Claims, No Drawings

CORROSION INHIBITION BY FORMATION OF IRON CARBOXYLATE

BACKGROUND OF THE INVENTION

1. Field of the Invention

The present invention relates to corrosion inhibition and more particularly to inhibition of corrosion of metal surfaces by means of a corrosion inhibitive iron carboxylate coating formed over the surface.

2. Description of Prior Art

Corrosion of metal surfaces, especially corrosion of ferrous metal surfaces, in various media has long been a troublesome problem. Such surfaces are subjected or exposed to corrosive media in a wide variety of environments. One particularly conspicuous environment prone to corrosion may be found in oil and gas wells and fields, where carbon dioxide and sulfide corrosion of ferrous metal surfaces in oil and gas wells and pipelines is especially troublesome.

One response to such corrosion problems has been the use of corrosion inhibitors that coat corrosion-prone surfaces with a film or coating. The film forms a barrier between the metal surface and the corrosive medium.

In many situations, however, conventional films have not been found to provide completely satisfactory corrosion inhibition. An especially troublesome environment has been found to be those in which the inhibitor coating is subjected to significant shear forces, such as result from high flow rates of the medium across or at the coated metal, typically ferrous metal, surface. For example, many oil wells have been producing at increasing production rates, thereby increasing the shear stress applied to the pipe walls. These shear stresses tend to wear or strip away coatings of corrosion inhibitors from the metal surface.

Another problem with conventional film-type corrosion inhibitors is that they typically are not uniformly effective in a wide variety of media. Thus, while the efficacy of some inhibitors have been found to be acceptable in water-rich media, the efficacy of such inhibitors in inhibiting corrosion has been found to be less adequate in hydrocarbon-rich media. Likewise, inhibitors useful in hydrocarbon media have been found to be less so in aqueous media. However, such inhibitors are not as effective as desired even in the medium to which they are more suited, and more effective corrosion inhibition and more persistent inhibition in both types of media and other media is desired.

As a result, compositions and techniques that form films that provide highly effective corrosion inhibition and cling more tenaciously to the metal surface, thereby to be more resistant to shear forces, are still being sought. The need for such compositions and techniques is especially significant with respect to the particularly serious corrosion problems associated with ferrous metal surfaces such as iron and steel surfaces, and with respect to corrosion caused by exposure of such surfaces to carbon dioxide and sulfides. It is also desired that such compositions and techniques be adaptable to the wide variety of media, allowing optimization for each medium, while maintaining formulatability of the inhibitor composition in an inhibitor product including in the composition and a solvent.

SUMMARY OF THE INVENTION

The present invention, therefore, is directed to a novel method for inhibiting corrosion of a metal surface bearing a corrosion product including ferrous ions. The method comprises applying to the surface a reaction product of an alcohol and a fatty acid maleic anhydride adduct that has been produced by a reaction between maleic anhydride and an unsaturated fatty acid.

In another aspect, the present invention is directed to a novel method for inhibiting corrosion of a ferrous metal surface in which the surface is allowed to corrode to a limited degree to form a film of corrosion product containing ferrous ions, and then a reaction product of an alcohol and a fatty acid maleic anhydride adduct is applied to the surface.

The present invention is also directed to a novel metal surface coated with an iron carboxylate produced by reaction of ferrous ions with a reaction product of an alcohol and a fatty acid maleic anhydride adduct produced by a reaction between maleic anhydride and an unsaturated fatty acid.

The present invention further is directed to a novel iron carboxylate produced by reaction of ferrous ions with a reaction product of an alcohol and a fatty acid maleic anhydride adduct produced by a reaction between maleic anhydride and an unsaturated fatty acid.

The present invention also is directed to a novel method for inhibiting corrosion of a metal surface bearing a corrosion product including ferrous ions. The method comprises applying to the surface a reaction product of an alcohol and a fatty acid maleic anhydride adduct selected from the group consisting of

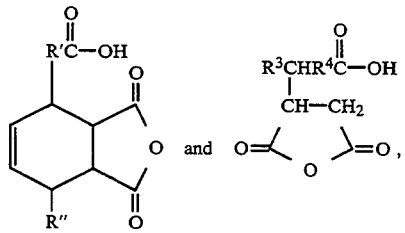

wherein R′ is a generally linear organic moiety of from about two to about 20 carbon atoms and R″ is hydrogen or a generally linear organic moiety of up to about 20 carbon atoms, the total number of carbon atoms in R′ and R″ being from about 10 to about 20 carbon atoms.

The present invention further is directed to a novel method for inhibiting corrosion of a metal surface bearing a corrosion product including ferrous ions. The method comprises applying to the surface a corrosion inhibitor selected from the group consisting of

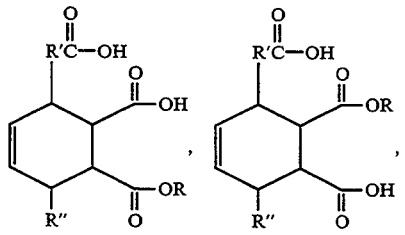

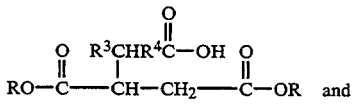

-continued

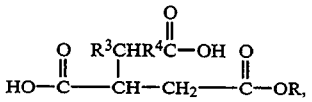

wherein R is hydrogen or an alkyl, aryl, aralkyl or alkaryl group of from about one to about twenty carbons, R′ is a generally linear organic moiety of from about two to about 20 carbon atoms and R″ is hydrogen or a generally linear organic moiety of up to about 20 carbon atoms, the total number of carbon atoms in R′ and R″ being from about 10 to about 20 carbon atoms, $R^3$ is an alkyl or alkenyl group of from about two to about fifteen carbons and $R^4$ is an alkylene or alkenylene group of from about two to about fifteen carbons.

Among the several advantages of this invention, may be noted the provision of a method for inhibiting corrosion of ferrous ion-bearing metal surfaces by application of a film-type inhibitor that affords better persistence against shear forces than do other inhibitors; the provision of such method which enables customization of the film to the medium to which the surface is otherwise exposed, thereby permitting optimization of the film; the provision of a metal surface bearing such film; and the provision of an iron carboxylate complex useful as such film.

DETAILED DESCRIPTION OF THE PREFERRED EMBODIMENTS

In accordance with the present invention, it has been discovered that applying a reaction product of an alcohol and a fatty acid maleic anhydride adduct to a surface bearing ferrous ions, such as a slightly corroded iron or steel surface, a coating that affords highly effective corrosion inhibition and that is surprisingly resistant to shear forces can be formed on the metal surface. More specifically, the alcohol may be selected for coordination with the medium to which the coated metal surface is to be exposed, permitting customization of the solubility of the reaction product to the medium, and further coordination with the solvent to be used in the corrosion inhibitor product. The ability to coordinate the corrosion inhibitor to the medium enables the formation of coatings designed specifically for particular media, which in turn enables the formation of especially high persistence coatings in the media. These customized coatings have been found to be more persistent than prior art films. Thus, by selecting reaction products of reduced solubility in the medium, coatings of high persistence and resistance to shear forces have been prepared.

According to this method, for example, an inhibitor that is soluble in methanol can be prepared while conventional inhibitors of similar type generally are insoluble in methanol. As a result, the new inhibitor may be formulated in methanol, which can aid in water removal from a medium to be treated. Thus, the common practice of employing a two-step process in oil and gas wells of adding methanol and then the inhibitor can be avoided.

Moreover, not only can the inhibitor be designed for methanol solubility, but also for insolubility in the medium to which the metal surface to be treated is exposed. Thus, for example, the inhibitor may be methanol soluble and the resulting carboxylate complex between the inhibitor adduct and iron ions water insoluble if the medium is aqueous. By way of another example, the inhibitor may be formulated in crude oil. As used in this respect, "soluble" means that the inhibitor can be dissolved readily in the solvent of interest, and "insoluble" means that the carboxylate does not readily dissolve into the medium.

The method requires that the metal surface bear a film of ferrous ions before application of the inhibitor. The film may be heavily peppered and need not be uniform or continuous. A simple means for applying the film on a ferrous metal surface in a corrosive medium (i.e., a medium in which the surface lends to corrode) is to allow the surface to sit in the medium for a short time so that a limited degree of corrosion forms a film on the surface. Then the inhibitor may be applied to the surface, forming an iron carboxylate and halting the corrosion.

The fatty acid maleic anhydride adduct may be prepared from maleic anhydride and any unsaturated fatty acid. Preparation of preferred adducts have been described previously; for example, in U.S. Pat. Nos. 4,658,036 and 4,927,669, which are incorporated herein by reference. The unsaturated fatty acid may be mono-, di- or poly-unsaturated. Tall oil fatty acids have been found to be especially useful and the most preferred fatty acid is conjugated linoleic acid, but unconjugated linoleic acid and other unsaturated, fatty carboxylic acids are suitable. Of these other acids, it is preferred that they be at least di-unsaturated and, optimally, conjugated. It is also preferred that the acid have from about fourteen to about 22 carbon atoms, especially from about sixteen to about eighteen carbon atoms. Such acids may be represented by the idealized formula R*C(:O)OH, wherein R* is an unsaturated aryl, arylalkenyl, arylalkyl, alkylaryl, alkenylaryl or, optimally, alkenyl group, preferably at least di- unsaturated, of from about thirteen to about 21 carbons, preferably from about fifteen to about seventeen carbons. Thus, tall oil fatty acids are preferred and aside from conjugated and unconjugated linoleic acid, suitable acids may include, for example, oleic and elaidic acids.

Preferably, the fatty acid is di- or poly- unsaturated and the reaction between the maleic anhydride and unsaturated fatty acid may involve the conversion of double bonds to a cyclic structure and so may be a cyclo-addition of a Diels-Alder type, particularly in the case in which the double bonds in fatty acid are conjugated. Thus, the resulting adduct may be of the formula

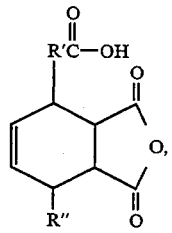

wherein R′ is a generally linear organic moiety of from about two to about 20 carbon atoms and R″ is hydrogen or a generally linear organic moiety of up to about 20 carbon atoms, the total number of carbon atoms in R′ and R″ being from about 10 to about 20 carbon atoms. However, while reaction of the traditional Diels-Alder type is preferred, the cyclo-addition reaction need not be of such type in that it does not require that the cyclic structure formed be six membered ring or that the unsaturated fatty acid be conjugated. It is believed that "endo", "ene" or other cyclo-addition reactions would yield suitable products.

Alternatively, the reaction may be a simple addition reaction, especially in those situations in which the fatty acid is mono-unsaturated. In a typical reaction between maleic anhydride and a mono-unsaturated fatty acid, the addition occurs at the carbon atom next to one which is double bonded to give compounds such as

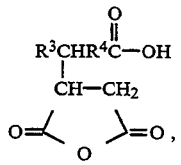

wherein $R^3$ is an alkyl or alkenyl group of from about two to about fifteen carbons and $R^4$ is an alkylene or alkenylene group of from about two to about fifteen carbons.

The resulting product, therefore, is mono-, di- or poly-cyclic, with one of the cyclic structures being the maleic anhydride moiety and another cyclic structure resulting from the reaction at the carbon-carbon double bond of the maleic anhydride reactant. The latter cyclic structure preferably includes at least one pendent chain that is a residue from the fatty acid. The chain terminates with a carboxyl group and may be represented by the formula —R'C(:O)OH, wherein R' is a generally linear organic moiety, preferably an alkylene or an alkenylene, especially of from about five to about ten carbons. Optimally, R' is an alkylene.

The latter cyclic structure may also include another pendent chain that is a residue from the fatty acid. That chain is likewise a generally linear organic moiety. Preferably, it is an alkyl or alkenyl, especially alkyl, group of, for example, from one to about ten carbons. In other words, if the fatty acid is conjugated such that it may be represented as R"CH:CHCH:CHR'C(:O)OH, wherein R' is as described above and R" is an alkyl or alkenyl, especially alkyl, group such that the total carbons of the acid is from about 14 to about 22 (preferably, about 16 to about 18), the resulting adduct may be represented as

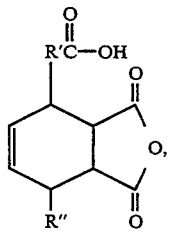

as noted above.

The fatty acid maleic anhydride adduct is then reacted with an alcohol. Thus, the adduct is reacted with a composition of the form ROH, wherein R is an organic moiety. Generally, the reaction is carried out under ambient conditions, preferably with an excess of alcohol. Preferred organic moieties include alkyl, aryl, aralkyl, alkaryl or amine groups. The composition ROH may be an ethoxylated alcohol or a phenol. The reaction is an esterification reaction that takes place at the anhydride moiety, converting the anhydride segment

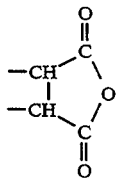

to the form

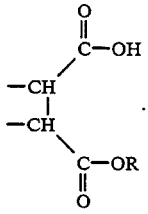

The reaction product therefore includes at least three carboxyl groups.

Thus, where R, R', R", $R^3$ and $R^4$ are defined as above, reaction of ROH with an adduct of the formula

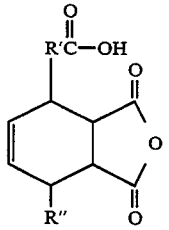

yields a compound of the formula

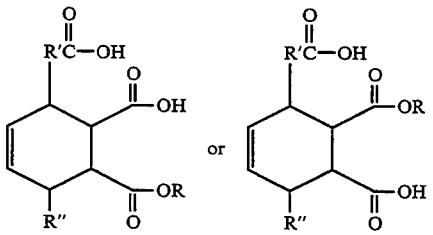

or a mixture thereof. Reaction of an adduct of the formula

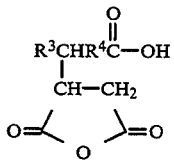

yields a compound of the formula

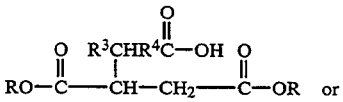

-continued

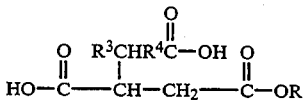

or a mixture thereof.

Upon application of the alcohol/adduct reaction product to a metal surface bearing ferrous ions (typically in the form of iron sulfide in the case of sulfide-type corrosion or iron carbonate in the case of carbon dioxide corrosion), such as a corroding iron or steel surface, an iron carboxylate complex is formed between the alcohol/adduct reaction product and the ferrous ions on the metal surface. In particular, the complex is believed to result from the electrostatic attraction between the negative charge at the double-bonded oxygens of the multiple carboxyl groups and the positively charged ferrous ions on the metal surface. Thus, superior film formation results from allowing at least slight pre-corrosion of a ferrous metal surface before application of the alcohol/adduct reaction product. It is preferred that the surface include a film or coating of the ferrous composition thereby to provide a substrate for a continuous and complete inhibitor coating.

The alcohol/adduct reaction product may be applied by any of the various standard techniques for application of film-type corrosion inhibitors to metal surfaces provided, however, that in the desired technique of the present invention, the metal surface is a ferrous metal surface and is allowed to pre-corrode at least slightly prior to application. Thus, for instance, the product may be sprayed, poured or painted onto the surface to be treated. Or, the surface may be dipped into a bath of the product. In other words, the product need only be brought into contact with the surface in some manner. By way of example, for application to oil or gas wells, the well may be turned off, the product solution (such as a 10 or 11% solution in crude oil) may be pumped into the well and, by tubing displacement, pushed to the bottom of the well by pumping crude oil into the well on top of the product solution, and the well turned back on. This technique provides two passes of inhibitor—one on the way down and another on the way back up.

The method of this invention provides a simple mechanism for customizing the corrosion inhibitor film to the system, thereby allowing optimization of film persistence in the particular system. By selecting an alcohol with an appropriate R group, the solubility in the medium of the iron complex formed with the alcohol/adduct reaction product can be selected. For maximum film persistence, the solubility of the film in the medium should be minimized, therefore to reduce the tendency of the film to go into solution. Thus, the alcohol ROH is selected in coordination with the medium to which the metal surface is exposed. For example, for a water-rich medium, a product of low water-solubility is preferred and, for example, a lower alkanol such as methanol or ethanol might be selected.

On the other hand, for a hydrocarbon-rich medium of little or no water, a water-soluble, hydrocarbon-insoluble product would be employed and a polyethoxy alcohol wherein ROH is of the form $(CH_2CH_2O)_xH$ (x being an integer, for example, from 1 to about 20) might be employed. Selecting the proper alcohol for reaction with the adduct also permits the preparation of a reaction product that is soluble in an appropriate solvent for formulation as a corrosion inhibitor product. Thus, for example, for formulation of a product including xylene as a solvent and for application of such product in a medium that is water-rich, an alcohol (such as a lower alkanol) that would afford high xylene-solubility to the adduct and low water solubility to the film would be selected.

The alcohol/adduct reaction product may be formulated with an organic solvent and other ingredients, such as demulsifiers, as desired. For example, a typical formulation might comprise 40% by weight reaction product, 5% by weight alcohol such as isopropyl alcohol in the case in which the surface is in a water-rich medium, and 55% organic solvent such as xylene. Another formulation might comprise a 10 or 11% or even a 25% by weight solution of inhibitor in methanol or crude oil. A demulsifier may be added to this formulation if desired.

The technique of this invention has been found to be particularly effective against carbon dioxide corrosion. It is believed that such superior efficacy is associated with protection against sulfide corrosion as well. The film, as noted, may be customized for the particular medium for improved persistence and resistance to shear forces induced, for example, by flow or movement of the medium across the surface. Thus, for example, where the adduct itself might have a solubility in a hydrocarbon-rich medium that is so high that it tends to solubilize into solution, reaction of the adduct with a polyethoxy alcohol may reduce the hydrocarbon solubility of the film prepared therefrom, thereby increasing the persistence the film.

The following examples describe preferred embodiments of the invention. Other embodiments within the scope of the claims herein will be apparent to one skilled in the art from consideration of the specification or practice of the invention as disclosed herein. It is intended that the specification, together with the examples, be considered exemplary only, with the scope and spirit of the invention being indicated by the claims which follow the examples. In the examples, all percentages are given on a weight basis unless otherwise indicated.

EXAMPLE 1

A wide variety of conventional inhibitors were prescreened for most likely candidates for persistent corrosion inhibitive coatings. The inhibitors were prescreened by measuring their affinities to corroding surfaces. The affinity was determined by dipping coupons in inhibitor formulations, drying the coupons and then weighing the coupons. The filmed coupons then were submerged overnight in Isopar M. After removing the coupons from the Isopar M, they were dried and weighed and the film was checked by copper ion displacement test. The most successful type of product according to this test was found to be a mixture of dimer and trimer acids. Thus, a commercial mixture containing dimer and trimer acids, as well as mono acids (which are typical by-products of a dimerization process) was selected for further testing against formulations of the present invention.

Rotating cylinder electrode tests were conducted to study the effectiveness of corrosion inhibitors under shear stress. Pursuant to these tests, cylindrical electrodes precorroded for one hour in a corrosive solution of carbon dioxide sparged brine and Isopar M were dipped into a 1:1 dilutions of inhibitor in xylene for one minute. Liquids present on the electrodes were wiped off carefully and then the filmed electrodes were dipped in Isopar for one minute to remove excess solvent. The filmed electrodes then were placed back in the corrosive solution and spun at a preset rate. The corrosion rate was measured periodically by PAIR readings. Iron counts also were taken during the experiments and the weight losses of the test electrodes were determined at the end of the experiments.

The corrosion rate at the end of the one hour pre-corrosion was found to be about 80 to 90 mpy. Before the electrodes were placed back in the corrosive solutions after the pre-corrosion, one of the electrodes was not filmed with inhibitor, one was filmed with the commercial dimer, trimer and mono acid mixture, one was filmed with an inhibitor solution comprising Tenax 2010 (40%), i-propyl alcohol (5%) and xylene (55%) in combination with a sulfonate-type demulsifier and one electrode was filmed with an inhibitor solution comprising Tenax 2010 (40%), i-propyl alcohol (5%) and xylene (55%) in combination with a demulsifier that is a formulation of alkoxylated phenolic resins, identified in the table below as Blank, Commercial, Inhibitor 1 and Inhibitor 2, respectively. Tenax 2010 is a trade designation of Westvaco Corporation for a tall oil fatty acid maleic anhydride adduct. The following corrosion rates (in mpy) were measured for each hour following initial immersion for pre-corrosion (Hour):

| | CORROSION RATES | | | |
|---|---|---|---|---|
| Hour | Blank | Commercial | Inhibitor 1 | Inhibitor 2 |
| 1 | 83 | 0 | 0 | 4 |
| 2 | 85 | 1 | 1 | 5 |
| 3 | 85 | 2 | 1 | 5 |
| 4 | 87 | 3 | 1 | 5 |
| 5 | 90 | 4 | 1 | 5 |
| 6 | 95 | 6 | 1 | 5 |
| 7 | 100 | 8 | 1 | 5 |
| 8 | 105 | 10 | 2 | 6 |
| 9 | 110 | 14 | 2 | 6 |
| 10 | 112 | 18 | 2 | 7 |
| 11 | 115 | 20 | 3 | 7 |
| 12 | 117 | 25 | 3 | 8 |
| 13 | 119 | 30 | 3 | 8 |
| 14 | 120 | 36 | 3 | 9 |
| 15 | 122 | 40 | 3 | 10 |
| 16 | 123 | 45 | 3 | 10 |
| 17 | 125 | 50 | 4 | 10 |
| 18 | 127 | 55 | 4 | 11 |
| 19 | 130 | 60 | 4 | 11 |
| 20 | 132 | 67 | 5 | 11 |
| 21 | 134 | 70 | 5 | 12 |
| 22 | | 75 | 5 | |
| 23 | | 80 | 5 | |

At the end of 24 hours, weight loss was measured for each electrode as well as one in which the electrode was filmed with an inhibitor solution comprising Tenax 2010 (40%), i-propyl alcohol (5%) and xylene (55%) without a demulsifier (Inhibitor 3). The results were as follows, with no correction for the one hour pre-corrosion:

| Inhibitor | Weight Loss (mpy) |
|---|---|
| Commercial | 72.6 |
| Inhibitor 1 | 16.1 |
| Inhibitor 2 | 23.7 |
| Inhibitor 3 | 15.8 |

The iron count in the solution was also measured as another confirmation of the corrosion rate. The following results were obtained:

| Inhibitor | Iron Count (mpy) |
|---|---|
| Commercial | 63.6 |
| Inhibitor 1 | 13.9 |
| Inhibitor 2 | 20.2 |
| Inhibitor 3 | 13.9 |

EXAMPLE 2

Corrosion resistance studies similar to those conducted in Example 1, above, were carried out with a 10% solution of hydrolyzed tetrapropenylsuccinic anhydride in methanol (TPSA) and with an 11% solution of a mixture of Tenax 2010 (40%), isopropanol (5%) and light aromatic naphtha (55%) in methanol (Inhibitor 4). In the TPSA test, the coupon was dipped in the inhibitor solution at 1.5 hours. In the Inhibitor 4 test, the coupon was dipped in the inhibitor solution at 2 hours. The resulting corrosion rates (in mils per year) at the identified times were noted.

| Hours | Corrosion Rate |
|---|---|
| TPSA | |
| 0 | 190 |
| 0.25 | 170 |
| 0.5 | 125 |
| 0.75 | 125 |
| 1 | 180 |
| 1.25 | 180 |
| 1.5 | 95 |
| 1.75 | 100 |
| 2 | 100 |
| 2.25 | 100 |
| Inhibitor 4 | |
| 0 | 70 |
| 2 | 109 |
| 4 | 27 |
| 6 | 28 |
| 8 | 28 |
| 10 | 25 |
| 12 | 30 |
| 14 | 30 |
| 16 | 30 |
| 18 | 30 |
| 20 | 30 |
| 22 | 25 |
| 24 | 20 |
| 26 | 20 |

In view of the above, it will be seen that the several advantages of the invention are achieved and other advantageous results attained.

As various changes could be made in the above methods and compositions without departing from the scope of the invention, it is intended that all matter contained in the above description shall be interpreted as illustrative and not in a limiting sense.

What is claimed is:

1. A method for inhibiting corrosion of a metal surface bearing a corrosion product including ferrous ions, comprising applying to the surface a corrosion inhibitor selected from the group consisting of

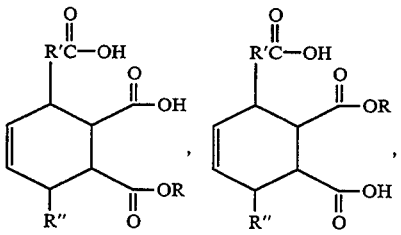

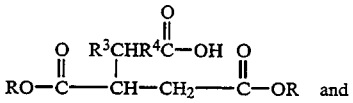

and

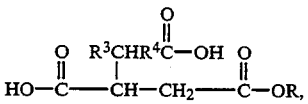

wherein R is hydrogen or an alkyl, aryl, aralkyl or alkaryl group of from about one to about twenty carbons, R′ is a linear organic moiety of from about two to about 20 carbon atoms and R″ is hydrogen or a linear organic moiety of up to about 20 carbon atoms, the total number of carbon atoms in R′ and R″ being from about 10 to about 20 carbon atoms, $R^3$ is an alkyl or alkenyl group of from about two to about fifteen carbons and $R^4$ is an alkylene or alkenylene group of from about two to about fifteen carbons.

2. A method as set forth in claim 1 wherein the corrosion inhibitor reacts with the ferrous ions to form an iron carboxylate on the metal surface.

3. A method as set forth in claim 2 wherein metal surface is located in a corrosive medium and the iron carboxylate is insoluble in the medium.

4. A method as set forth in claim 3 wherein the medium is aqueous and the corrosion inhibitor is soluble in methanol and is applied in a methanol solution.

5. A method for inhibiting corrosion of a metal surface bearing a corrosion product including ferrous ions, comprising applying to the surface a reaction product of an alcohol and a fatty acid maleic anhydride adduct selected from the group consisting of

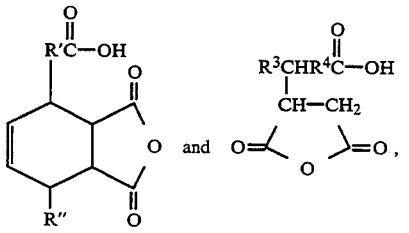

wherein R′ is a linear organic moiety of from about two to about 20 carbon atoms and R″ is hydrogen or a linear organic moiety of up to about 20 carbon atoms, the total number of carbon atoms in R′ and R″ being from about 10 to about 20 carbon atoms.

6. A method as set forth in claim 5 wherein the alcohol is of the form ROH wherein R represents an alkyl, an aryl or an arylalkyl group of from about 1 to about 30 carbons.

7. A method as set forth in claim 6 wherein R represents an alkyl, an aryl or an arylalkyl group of from about 1 to about 10 carbons.

8. A method as set forth in claim 7 wherein R represents an isopropyl group.

9. A method as set forth in claim 5 wherein the fatty acid maleic anhydride was produced by a reaction between maleic anhydride and conjugated linoleic acid.

10. A method for inhibition of corrosion of a ferrous metal surface, comprising the steps of:

a. allowing the surface to corrode to a limited degree thereby to form over the surface a film of corrosion product containing ferrous ions, thereby forming a precorroded surface; and b. applying to the precorroded surface a corrosion inhibitor selected from the group consisting of

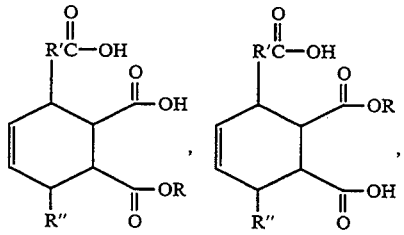

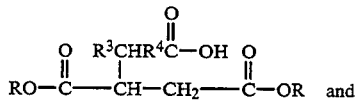

and

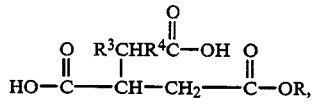

wherein R is hydrogen or an alkyl, aryl, aralkyl or alkaryl group of from about one to about twenty carbons, R′ is a linear organic moiety of from about two to about 20 carbon atoms and R″ is hydrogen or a linear organic moiety of up to about 20 carbon atoms, the total number of carbon atoms in R′ and R″ being from about 10 to about 20 carbon atoms, $R^3$ is an alkyl or alkenyl group of from abut two to about fifteen carbons and $R^4$ is an alkylene or alkenylene group of from about two to about fifteen carbons.

11. A method as set forth in claim 10 wherein the metal surface is located in a corrosive medium and the iron carboxylate is insoluble in the medium.

12. A method as set forth in claim 11 wherein the medium is aqueous and the corrosion inhibitor is soluble in methanol and is applied in a methanol solution.

* * * * *